US010308325B2

(12) United States Patent
Al Zuhairy et al.

(10) Patent No.: US 10,308,325 B2
(45) Date of Patent: Jun. 4, 2019

(54) MOORING UNIT FOR MOORING A SHIP

(71) Applicant: European Intelligence B.V., Dordrecht (NL)

(72) Inventors: Nezhat Al Zuhairy, Dordrecht (NL); Gerardus Antonius Jozef Mampaeij, Dordrecht (NL); Johan Marlon Boerleider, Dordrecht (NL)

(73) Assignee: EUROPEAN INTELLIGENCE B.V., Dordrecht (NL)

( * ) Notice: Subject to any disclaimer, the term of this patent is extended or adjusted under 35 U.S.C. 154(b) by 33 days.

(21) Appl. No.: 15/395,625

(22) Filed: Dec. 30, 2016

(65) Prior Publication Data

US 2017/0197688 A1 Jul. 13, 2017

(30) Foreign Application Priority Data

Jan. 7, 2016 (NL) ..... 2016062

(51) Int. Cl.

| | |
|---|---|
| ***B63B 21/00*** | (2006.01) |
| ***B63B 21/50*** | (2006.01) |
| ***B63B 21/54*** | (2006.01) |
| ***E02B 3/24*** | (2006.01) |

(52) U.S. Cl.

CPC ..... *B63B 21/507* (2013.01); *B63B 21/54* (2013.01); *E02B 3/24* (2013.01); *B63B 2021/001* (2013.01); *B63B 2021/008* (2013.01); *B63B 2021/501* (2013.01)

(58) Field of Classification Search

CPC ..... B63B 21/00; B63B 2021/001; B63B 2021/002; B63B 2021/003; B63B 2021/004; B63B 2021/005; B63B 2021/006; B63B 2021/007; B63B 2021/008; B63B 2021/009; B63B 21/02

See application file for complete search history.

(56) References Cited

U.S. PATENT DOCUMENTS

| | | | | |
|---|---|---|---|---|
| 3,371,801 A * | 3/1968 | Widegren | ..... | B66C 23/64 182/41 |
| 3,515,090 A * | 6/1970 | Chambers | ..... | B63B 35/70 114/251 |
| 4,611,842 A * | 9/1986 | Epstein | ..... | B63B 21/60 294/82.27 |

(Continued)

FOREIGN PATENT DOCUMENTS

| | | |
|---|---|---|
| EP | 2549020 | 1/2013 |
| WO | 91/14615 | 10/1991 |

(Continued)

*Primary Examiner* — Andrew Polay

(74) *Attorney, Agent, or Firm* — Peacock Law P.C.; Janeen Vilven

(57) ABSTRACT

Mooring unit for mooring a ship comprising a base, an arm mounted on the base, and a hook supported by the arm for connecting a mooring line of the ship, wherein the arm is movable between a retracted position and an extended position, and wherein the unit comprises an actuating device for moving the arm from the extended position to the retracted position, wherein the arm is mounted on a first part of the base and wherein the first part of the base is rotatably mounted on a second part of the base that is rotationally fixed, to enable rotation of the first part of the base around a vertical axis perpendicular to the horizon.

9 Claims, 4 Drawing Sheets

(56) References Cited

U.S. PATENT DOCUMENTS

| | | | | |
|---|---|---|---|---|
| 5,408,946 | A * | 4/1995 | Jones | B63B 21/00 114/230.1 |
| 7,296,527 | B2 * | 11/2007 | Toth | E02B 3/20 114/199 |
| 2014/0338581 | A1 * | 11/2014 | Gill | B63B 21/04 114/230.21 |
| 2015/0047545 | A1 * | 2/2015 | Boerleider | B63B 21/02 114/230.15 |

FOREIGN PATENT DOCUMENTS

| | | |
|---|---|---|
| WO | 2010/110666 | 9/2010 |
| WO | 2013/115958 | 8/2013 |

* cited by examiner

MOORING UNIT FOR MOORING A SHIP

CROSS-REFERENCE TO RELATED APPLICATIONS

This application claims priority to, and the benefit of filing of Netherlands Patent Application No. 2016062, filed on Jan. 7, 2016, and the specification and claims thereof are incorporated herein by reference.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION BY REFERENCE OF MATERIAL SUBMITTED ON A COMPACT DISC

Not Applicable.

STATEMENT REGARDING PRIOR DISCLOSURES BY THE INVENTOR OR A JOINT INVENTOR

Not Applicable.

COPYRIGHTED MATERIAL

Not Applicable.

BACKGROUND OF THE INVENTION

Field of the Invention (Technical Field)

The present invention relates to mooring unit for mooring a ship comprising a base, an arm mounted on the base, and a hook supported by the arm for connecting a mooring line of the ship, wherein the arm is movable between a retracted position and an extended position, and wherein the unit comprises an actuating device for moving the arm from the extended position to the retracted position.

Description of Related Art Including Information Disclosed Under 37 C.F.R. §§ 1.97 and 1.98:

Mooring units are known from WO2013/115958. This known mooring unit has an actuator connected to a mooring hook and a mooring base. The actuator provides translational movement of the mooring hook towards the mooring base. The mooring unit also includes a vessel motion detection system and a mooring unit control system. The mooring unit may include a mooring line tension gauge. The vessel motion detection system provides an input indicative of vessel motion to the mooring unit control system. The mooring unit control system then provides an output signal to the appropriate parts of the unit to adjust the mooring line tension.

BRIEF SUMMARY OF THE INVENTION

The invention aims to address different problems of the mooring unit of the prior art.

A first objective of the invention is to provide a mooring unit which is better equipped to adapt to different ship motions and forces caused by such motions, such as heave, sway, surge, yaw, pitch and roll.

A second objective of the invention is to provide a mooring unit which is equipped to provide improved damping to the ship motions.

A third objective of the invention is to provide a mooring unit which exhibits variable stiffness behavior, such that the stiffness increases with increasing excursion of the arm towards its extended position.

As a fourth objective of the invention aims to pro-vide a mooring unit that is both simple and reliable.

According to the invention a mooring unit is proposed in accordance with one or more of the appended claims.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
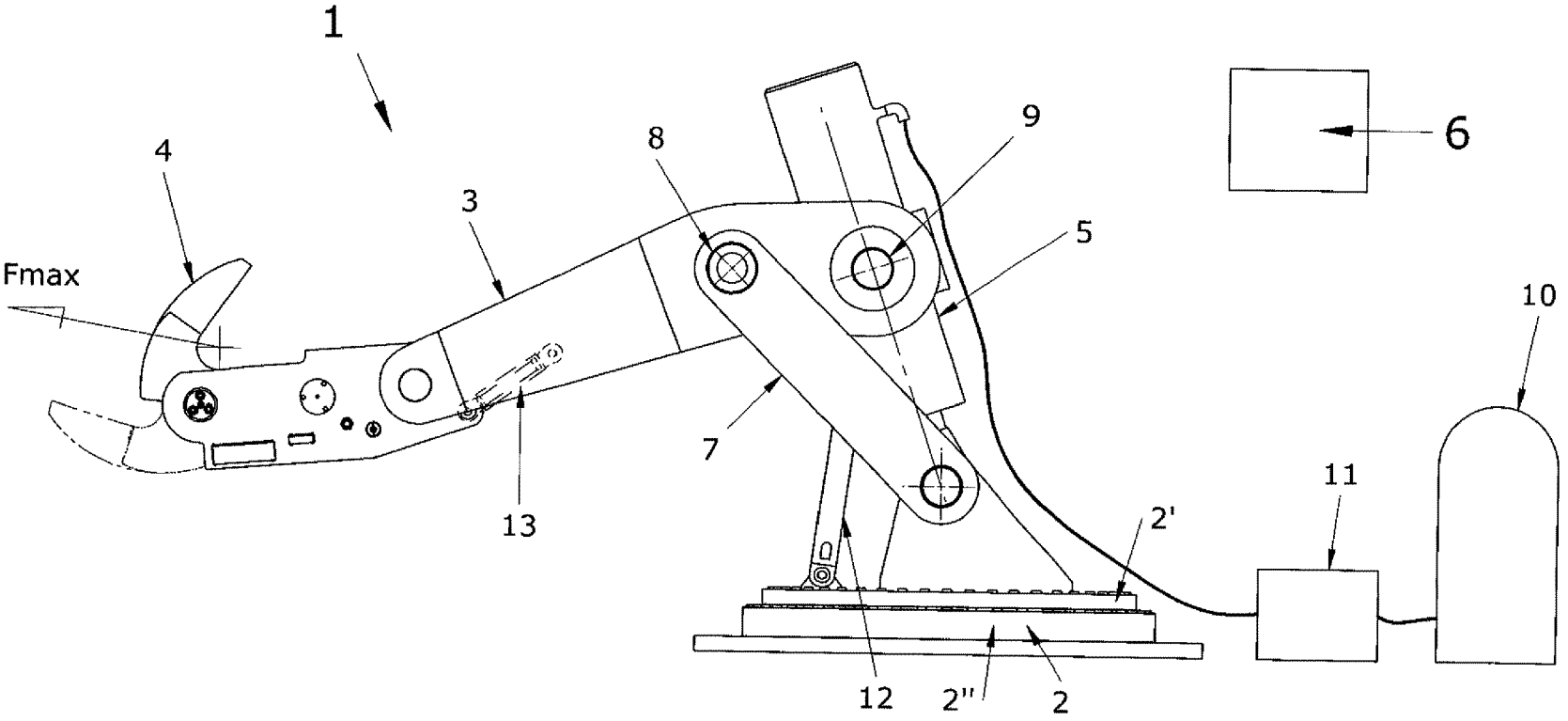
FIG. 1 shows a side view of the mooring unit according to the invention, wherein the arm is in the extended position.

According to a first aspect of the invention the arm is mounted on a first part of the base, which first part of the base is rotatably mounted on a second part of the base that is rotationally fixed to enable rotation of the first part of the base around a vertical axis perpendicular to the horizon. This enables that the arm of the mooring unit can better follow back-and-forth movement of a moored ship without tensions increasing in the mooring line. Due to all degrees of freedom of the mooring unit, the unit will at all times be inline with the mooring line (load). Accordingly movement of the hook is dependent on and initiated by the tension in the mooring line and the varying directional forces acting on it.

According to a second aspect of the invention which can be applied independent from the first aspect or in combination therewith, the arm is mounted to the base with an intermediate rod, wherein one extremity of the rod connects to the base and an opposite extremity of the rod connects to the arm at a hinge distant from the hook, wherein the hinge is positioned on the arm between the hook and a position where the actuating device connects to the arm. This provides that the footprint of the mooring unit of the invention is restricted due to the feature that the construction of the invention results in conversion of horizontal motion into vertical motion. Accordingly the space that the mooring unit of the invention requires is limited since the horizontal motion of the arm between the retracted and the extended position corresponds with a vertical motion as embodied in the variable height of the mooring unit that depends on the movement of the arm. Another advantage is that this particular geometry supports the mooring unit's change of stiffness due to the fact that as the hook extends the ratio changes between the actuating device and the force arm, which results in a higher resistance provided to the hook load. In other words: movement of the arm from the retracted to the extended position causes that the arm's stiffness as measured at the hook of the mooring unit increases. This means that with greater excursions of the arm, the moored ship will be subjected to increased resistance. The mooring unit of the invention is suitably equipped to act on mooring forces having a time period of 6 seconds and higher. The mooring unit preferably comprises a control system to enable that the arm moves from the retracted position towards the extended position when a force applied on the hook away from the base exceeds a pre-established first threshold value.

The control system may include sensors for measuring a mooring load, hydraulic and pneumatic pressures in the mooring unit, temperature and parameters relating to the arm of the mooring unit.

The first threshold value is preferably between a pre-established minimum and a pre-established maximum value to prevent damage resulting from excessive forces to mooring ropes or lines and to the mooring unit itself.

If on the other hand the forces acting on the mooring unit are or have become low enough, the arm can be moved back from the extended position to the retracted position. Accordingly the mooring unit comprises an actuating device for moving the arm from the extended position to the retracted position. To this end it is preferable that the control system is arranged such that the arm, powered by the actuating device, moves towards the retracted position when a force applied on the hook away from the base falls below a pre-established second threshold value. Indeed, when forces generated by a moored ship's motion that act on the mooring unit fall below the pre-established second threshold, this is an indication that the mooring lines are tending to be slacking and that the arm has room to move back towards the retracted position to tightly secure the ship. It is then preferable that the mooring unit comprises an arm balancing element that acts as a spring to support the arm in moving back towards the retracted position.

Suitably the actuating device is one selected from the group comprising a hydraulic cylinder, a mechanical spring, a rotatable screw powered by an electric motor, a pneumatic cylinder, a mechanical energy dissipater, and any combination thereof.

Preferably, the actuating device is selected as a device capable to release potential energy to an energy storage device or accumulator, preferably a hydraulic cylinder. The energy which is stored in the energy storage device or accumulator upon movement of the arm from the retracted position towards the extended position can thus, at a later instance, be used to move the arm back from the extended position towards the retracted position when the forces acting upon the mooring unit have fallen below the pre-defined second threshold. This storage and re-use of energy allows the mooring unit to function essentially without any provision of energy from external sources.

An important feature of the mooring unit of the invention is that between the actuating device and the accumulator an energy dissipation element is provided to absorb at least a part of the energy received from the actuating device when the arm—subject to the motions of the moored ship—moves from the retracted position towards the extended position. Since the arm undergoes frequent movements due to the movements of the moored ship, the amount of energy available at the output of the actuating device is too high to be stored in the accumulator if this latter device has restricted dimensions. It is therefore required that the surplus of energy is dissipated.

The invention will hereinafter be further elucidated with reference to the drawing of an exemplary embodiment of a mooring unit according to the invention that is not limiting as to the appended claims.

Whenever in the figures the same reference numerals are applied, these numerals refer to the same parts.

FIGS. 1-4 show a mooring unit 1 for mooring a ship (not shown) comprising a base 2 comprising a first part 2' and a second part 2", an arm 3 mounted on the base 2, and a hook 4 supported by the arm 3 for connecting a mooring line (not shown) of the ship.

The arm 3 is mounted on the first part 2' of the base 2 and said first part 2' of the base 2 is rotatably mounted on the second part 2" of the base 2 which is rotationally fixed, which enables rotation of the first part 2' of the base 2 around a vertical axis perpendicular to the horizon, and makes possible that the mooring unit is aligned with the variable orientation of the mooring line that depends on the motions of the moored ship.

Figure 2:
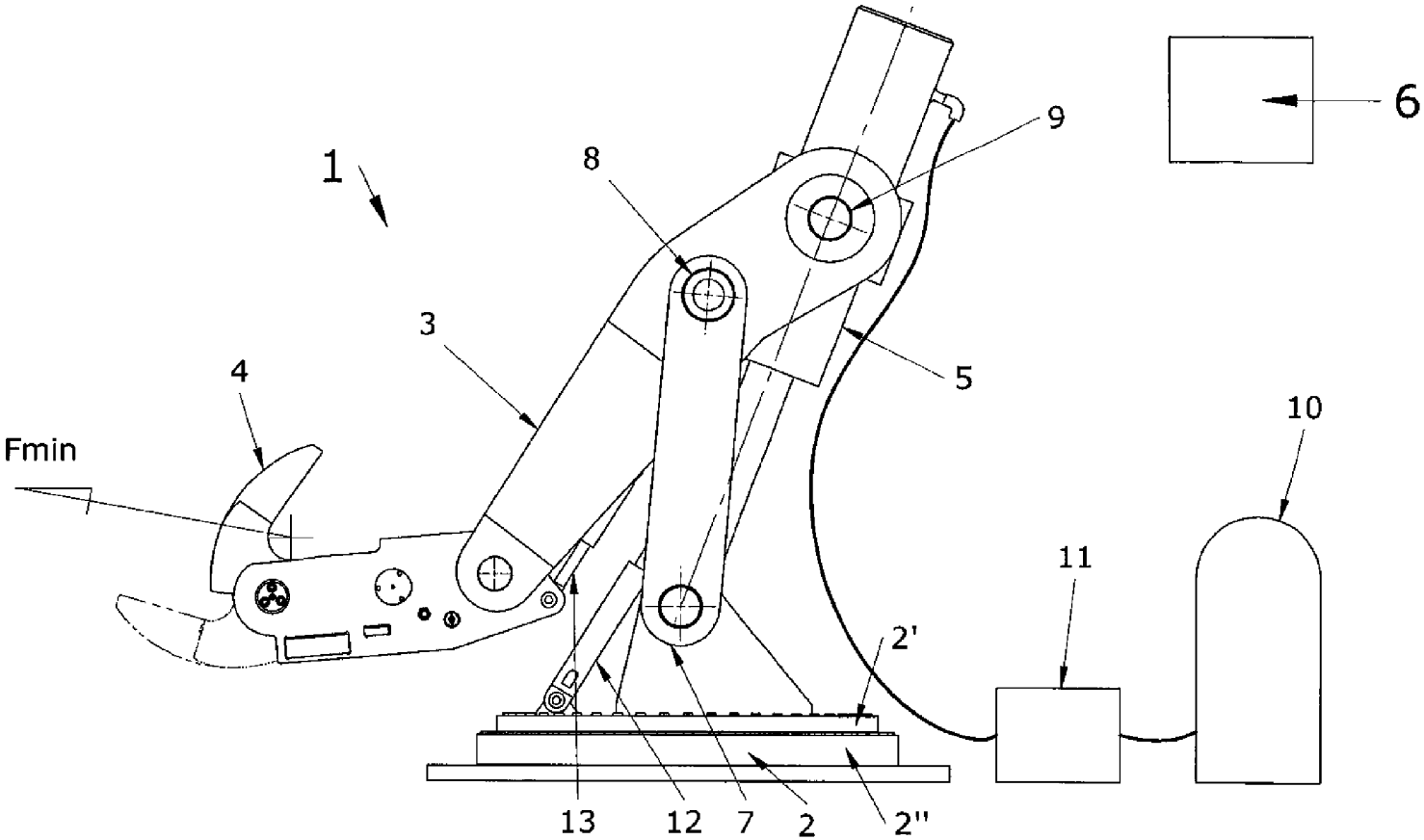
FIG. 2 shows a side view of the mooring unit according to the invention, wherein the arm is in the retracted position.
Figure 3:
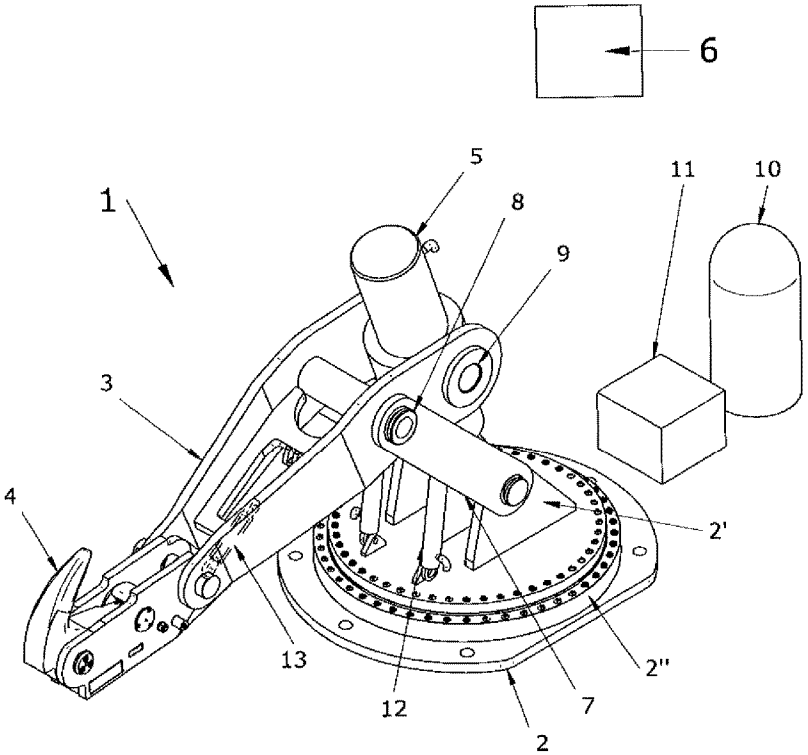
FIG. 3 shows a three dimensional view of the mooring unit according to the invention, wherein the arm is in the extended position.

The arm is further movable between a retracted position (FIGS. 2 and 4) and an extended position (FIGS. 1 and 3). The hook 4 is preferably embodied as a quick release hook which as such is known from the prior art and is shown in two positions represented by the continuous lines (=closed) and dashed lines (=open) in FIGS. 1 and 2, and in closed position only in FIGS. 3 and 4. A hook balancing element 13 between the arm 3 and the hook 4 is applied to maintain the hook 4 in a particular desired position.

Figure 4:
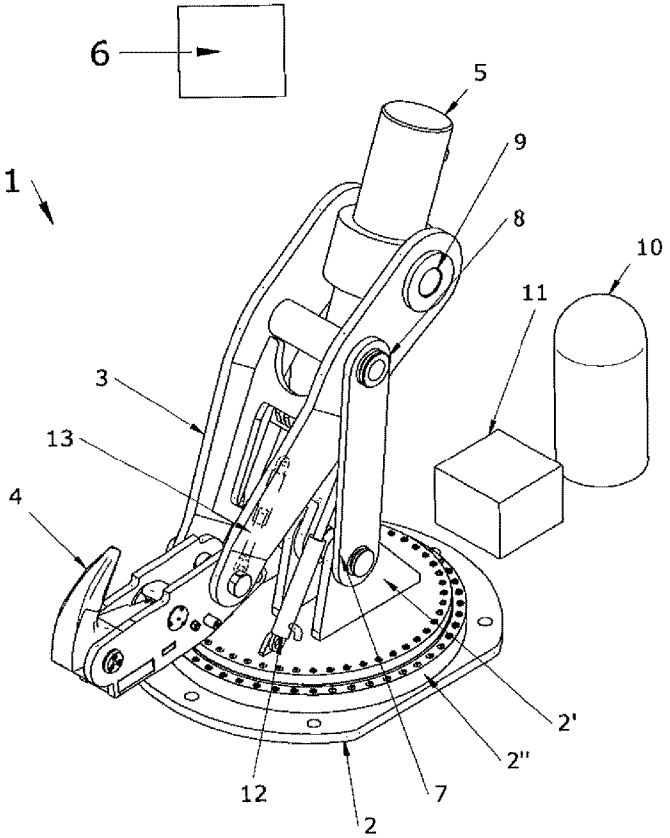
FIG. 4 shows a three dimensional view of the mooring unit according to the invention, wherein the arm is in the retracted position.

The mooring unit 1 comprises an actuating device, for instance a hydraulic cylinder 5 which accumulates energy when the arm 3 moves from the retracted position shown in FIGS. 2 and 4 to an extended position as shown in FIGS. 1 and 3. The energy from the hydraulic cylinder 5 is stored in an energy storage device such as an accumulator 10, and can later be used to energize the hydraulic cylinder 5 for moving the arm 3 back from the extended position shown in FIGS. 1 and 3 to the retracted position of FIGS. 2 and 4. It further shows an arm balancing element 12 that acts as a spring to support the arm 3 in moving back towards the retracted position.

Between the actuating device 5 and the accumulator 10 an energy dissipation element 11 is provided to absorb at least a part of the energy received from the actuating device 5 when the arm 3, subject to the forces of the moored ship, moves from the retracted position towards the extended position.

It is possible that the actuating device is not a hydraulic cylinder, but a mechanical spring, a rotatable screw powered by an electric motor, a pneumatic cylinder, a mechanical energy dissipater, or any combination thereof.

Figure 5:
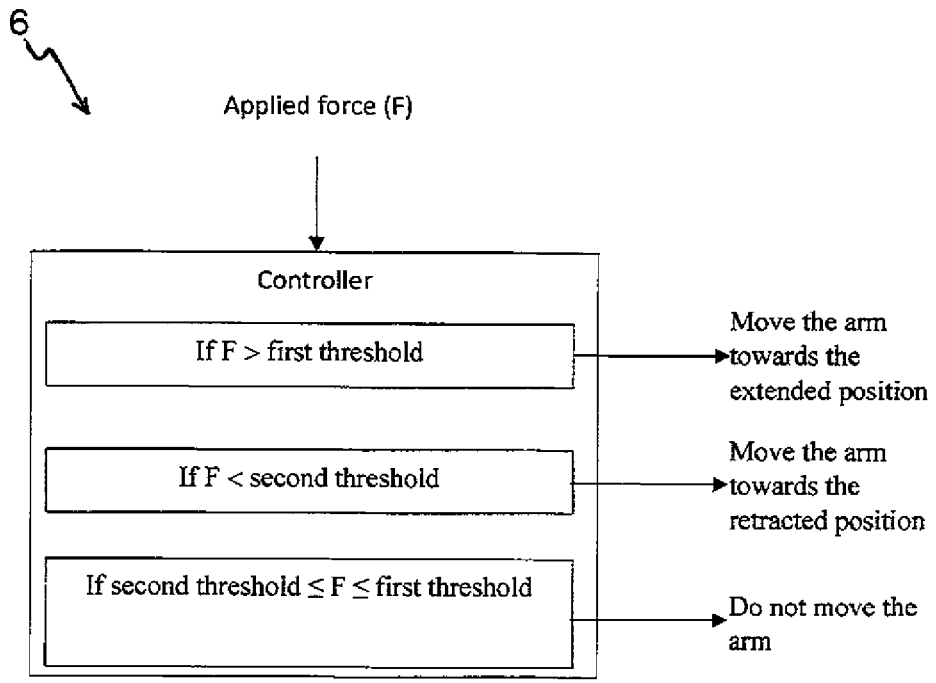
FIG. 5 shows a flow diagram representing the method of operation of the control system according to the invention.

To accommodate the intended operation of the mooring unit 1 as just described, the unit 1 comprises a control system 6 (the operation of which is schematically shown in FIG. 5) to enable that the arm 3 moves from the retracted position towards the extended position when a force (F, shown as an arrow in FIG. 2) is applied on the hook 4 away from the base 2 that exceeds a pre-established first threshold value. In addition the control system is arranged to power the actuating device such that the arm 3 moves back towards the retracted position when the force F that acts on the hook 4 in a direction away from the base 2 falls below a pre-established second threshold value.

Turning back to FIGS. 1-4 it is shown that the arm 3 is mounted to the base 2 with an intermediate rod 7, wherein one extremity of the rod connects to the base 2 and an opposite extremity of the rod connects to the arm 3 at a hinge 8 distant from the hook 4, wherein the actuating device 5 connects to the arm 4 at a second position 9 which second position 9 is further away from the hook 4 than the hinge 8. The position of the hinge 8 is chosen such that the hook 4 is enabled to follow a predefined curved trajectory when the arm 3 moves between the retracted and the extended positions. In particular this position arranges a desirable stiffness characteristic of the arm 3 of the mooring unit 1, wherein said stiffness increases when the arm moves from the retracted position to the extended position.

Although the invention has been discussed in the foregoing with reference to an exemplary embodiment of the mooring unit of the invention, the invention is not restricted to this particular embodiment which can be varied in many ways without departing from the invention. The discussed exemplary embodiment shall therefore not be used to construe the appended claims strictly in accordance therewith. On the contrary the embodiment is merely intended to explain the wording of the appended claims without intent to limit the claims to this exemplary embodiment. The scope of protection of the invention shall therefore be construed in accordance with the appended claims only, wherein a possible ambiguity in the wording of the claims shall be resolved using this exemplary embodiment.

NOMENCLATURE

1. Mooring unit
2. Base, first part 2', second part 2"
3. Arm
4. Hook
5. Actuating device
6. Control system
7. Rod
8. Hinge
9. Position connecting the actuating device 5 to the arm 3
10. Accumulator
11. Energy dissipation element
12. Arm balancing element
13. Hook balancing element

What is claimed is:

1. A mooring unit for mooring a ship comprising a base, an arm mounted on the base, and a hook supported by the arm for connecting a mooring line of the ship, wherein the arm is movable between a retracted position and an extended position, and wherein the unit comprises an actuating device for moving the arm from the extended position to the retracted position, wherein the arm is mounted on a first part of the base and wherein the first part of the base is rotatably mounted on a second part of the base that is rotationally fixed, to enable rotation of the first part of the base around a vertical axis perpendicular to the horizon, and wherein the arm is mounted to the base with an intermediate rod, wherein one extremity of the intermediate rod connects to the base and an opposite extremity of the intermediate rod connects to the arm, wherein the hinge is positioned on the arm between the hook and a position where the actuating device connects to the arm.

2. The mooring unit according to claim 1, wherein the unit comprises a control system that drives the actuating device so as to move the arm from the retracted position toward the extended position when a force applied on the hook away from the base exceeds a pre-established first threshold value.

3. The mooring unit according to claim 1, wherein the unit comprises a control system that drives the actuating device so as to move the arm toward the retracted position when a force applied on the hook away from the base falls below a pre-established second threshold value.

4. The mooring unit according to claim 1, wherein the unit comprises a spring-like arm balancing element that acts as a spring to support the arm in moving towards the retracted position.

5. The mooring unit according to claim 1, wherein the actuating device is one selected from the group consisting of a hydraulic cylinder, a mechanical spring, a rotatable screw powered by an electric motor, a pneumatic cylinder, a mechanical energy dissipater, and any combination thereof.

6. The mooring unit according to claim 1, wherein the actuating device is a device capable of releasing potential energy to an energy storage device or accumulator.

7. The mooring unit according to claim 6, wherein the energy storage device or accumulator is a hydraulic cylinder.

8. The mooring unit according to claim 6, further comprising an energy dissipation element located between the actuating device and the accumulator, wherein the energy dissipation element has at least a first and a second point of connection wherein said first point of connection is coupled to the actuating device and the second point of connection is coupled to the accumulator, and wherein the energy dissipation element absorbs at least a part of the energy received from the actuating device when the arm moves from the retracted position towards the extended position.

9. The mooring unit according to claim 6, wherein the actuating device is selected from the group comprising a hydraulic cylinder, a mechanical spring, a mechanical energy dissipater, a rotatable screw powered by an electric motor, a pneumatic cylinder, and any combination thereof.

* * * * *